United States Patent [19]

Kraus

[11] Patent Number: 5,039,030

[45] Date of Patent: Aug. 13, 1991

[54] WING EXTENDABLE FROM AN AIRBORNE BODY

[75] Inventor: Manfred Kraus, Eckental, Fed. Rep. of Germany

[73] Assignee: Diehl GmbH & Co., Nuremberg, Fed. Rep. of Germany

[21] Appl. No.: 517,945

[22] Filed: May 2, 1990

[30] Foreign Application Priority Data

Jun. 5, 1989 [DE] Fed. Rep. of Germany ..... 3918244

[51] Int. Cl.[5] ..... F42B 10/14

[52] U.S. Cl. ..... 244/3.28; 244/49

[58] Field of Search ..... 244/3.28, 49, 3.26, 244/3.27, 46

[56] References Cited

U.S. PATENT DOCUMENTS

| | | | |
|---|---|---|---|
| Re. 26,380 | 4/1968 | Rogallo | 244/46 |
| 3,990,656 | 11/1976 | Minnich | 244/3.27 |
| 4,106,727 | 8/1978 | Ortell | 244/49 |
| 4,351,499 | 9/1982 | Maudal et al. | 244/3.27 |
| 4,364,531 | 12/1982 | Knoski | 244/3.27 |
| 4,411,398 | 10/1983 | Wedertz et al. | 244/3.28 |
| 4,568,044 | 2/1986 | DiTommaso et al. | 244/3.27 |
| 4,586,680 | 5/1986 | DiTommaso et al. | 244/3.27 |
| 4,635,881 | 1/1987 | Brieseck et al. | 244/49 |
| 4,869,441 | 9/1989 | Steuer | 244/3.28 |
| 4,923,143 | 5/1990 | Steuer et al. | 244/3.28 |

FOREIGN PATENT DOCUMENTS

| | | | |
|---|---|---|---|
| 3026409 | 3/1982 | Fed. Rep. of Germany . | |
| 3234267 | 8/1983 | Fed. Rep. of Germany . | |
| 3234269 | 8/1983 | Fed. Rep. of Germany . | |
| 3340501 | 5/1985 | Fed. Rep. of Germany . | |
| 3340501 | 5/1985 | Fed. Rep. of Germany . | |
| 3403573 | 8/1985 | Fed. Rep. of Germany . | |
| 3417082 | 11/1985 | Fed. Rep. of Germany . | |
| 3432614 | 3/1986 | Fed. Rep. of Germany . | |
| 3523769 | 1/1987 | Fed. Rep. of Germany . | |
| 1597098 | 9/1981 | United Kingdom | 244/3.28 |

*Primary Examiner*—Michael J. Carone

*Attorney, Agent, or Firm*—Scully, Scott, Murphy & Presser

[57] ABSTRACT

An unfoldable wing which is extendable from an airborne body, wherein the wing includes a nose spar which has one end segment thereof pivotable about a bearing axis which is located on the airborne body, and a motive arrangement equipped with an energy accumulator or storage for effectuating the extension of the nose spar about the associated bearing axis. On the airborne body there is provided a base spar having a first end segment in proximity to the bearing axis for the nose spar, and with the base spar being oriented at least approximately parallel with the longitudinal axis of the airborne body, whereby the base spar is displaceable along its longitudinal direction and is operatively connectable or, essentially, operatively connected with the energy accumulator and with the nose spar for effectuating the extension of the nose spar. The airborne body, there is required only a relatively small amount of space for the base spar, so as to allow for a construction of the unfoldable wing for an outward extension from the airborne.

10 Claims, 5 Drawing Sheets

10
12
14
16
18
20
22
24
26
28,32
30
34
36
38
40
VIII
IX
X
XI
S 10
12
14
16
18
20
22
24
26
28
30
32
34
38,40

XV
XVI
XIV
10
12
14
18
20
30
38
40
42
46
48
50
52
54
56
58
60
62,66
64
68
70
72
74
d

WING EXTENDABLE FROM AN AIRBORNE BODY

BACKGROUND OF THE INVENTION

1. Field of the Invention

The present invention relates to an unfoldable wing which is extendable from an airborne body, wherein the wing includes a nose spar which has one end segment thereof pivotable about a bearing axis which is located on the airborne body, and a motive arrangement equipped with an energy accumulator or storage for effectuating the extension of the nose spar about the associated bearing axis.

In connection with an airborne body of that type, it must be understood that this includes; for example, a rocket which is started from a launch tube or a projectile which is to be fired from a weapon barrel, whereby the airborne body possesses a plurality of such types of unfoldable wings which are outwardly extendable, and which in their initial or stored position lie against the airborne body, and which are first outwardly extended and unfolded from the airborne body subsequent to their exiting from the launch tube or weapon barrel, in order to achieve a stabilizing of the trajectory for the airborne body.

2. Discussion of the Prior Art

In the disclosure of German Patent 34 32 614 A1 there is described an airborne body with outwardly extendable wings, whereby a motive device which is equipped with an energy accumulator for the extension of the wing, or each one of the wings, possesses a compressed gas container which is fluidally connected through the intermediary of a conduit with an inflatable member. In essence, the inflatable member can be readily space-savingly or compactly arranged in the interior of the airborne body in the inactive initial condition thereof, but on the other hand, there are encountered the conditions with regard to the compressed gas container. This container necessitates the provision for an amount of space which is not negligible and which reduces the proportion of the payload for the airborne body. With consideration being given to the fact that the inflatable member, in the activated condition of the airborne equipment, itself also presents a certain requirement for space, which must already be previously available, there is obtained a further reduction in the proportionate volume of the payload for such a type of airborne body.

The disclosure of U.S. Pat. No. 4,869,441, which is commonly assigned to the assignee of the present application, describes a submunition-airborne body with unfoldable glide wings, which are fastened to the fuselage of the airborne body so as to be outwardly extendable from grooves extending generally in parallel with the longitudinal axis of the airborne body. In that instance, the grooves are formed in attachments each for receiving, respectively, a retracted glide wing without requiring any access into the interior of the fuselage, and wherein the attachments extend radially away from the casing surface of the fuselage of the airborne body. A construction of that kind would be rational when a plurality of submunition-airborne bodies would be arranged within a carrier for such submunitions, inasmuch as it would then be rationally possible to utilize the dead space which is existent between the submunition-airborne bodies and the submunition-carrier by the attachments which project away from the fuselage of the airborne body, and in which attachments there are located the wings in their retracted condition. As a consequence of the presence of the attachments, within which the wings for the airborne body are located when retracted, such a type of airborne body is neither adapted nor is it contemplated to be started from a launch tube in the manner of a rocket, or to be fired per se as a projectile from a weapon barrel.

SUMMARY OF THE INVENTION

The invention accordingly has as its object to provide for an unfoldable wing of the above-mentioned type which is outwardly extendable from an airborne body, wherein there is need for only a small amount of space for the structural components which are utilized for the unfolding of the wing, and which components are connected with a motive arrangement possessing an energy accumulator or storage.

The foregoing object is inventively attained in that there is arranged, on the airborne body, a base spar having a first end segment in proximity to the bearing axis for the nose spar, and with the base spar being oriented at least approximately parallel with the longitudinal axis of the airborne body, whereby the base spar is displaceable along its longitudinal direction and is operatively connectable or, essentially, operatively connected with the energy accumulator and with the nose spar for effectuating the extension of the nose spar. In contrast with unfoldable or extendable wings which possess a nose spar, a rear spar and a root spar or base spar, which are constructed to form conjointly a linked triangle of variable surface, and which are covered with a fabric or wing covering, whereby the root or base spar is hingedly connected with the nose spar while remaining fixed in position, in this instance there is inventively employed the base spar for effectuating the extension of the nose spar. Inasmuch as the base spar extends along the longitudinal direction of the airborne body, there is required only a relatively small amount of space for the base spar, so as to allow for a construction of the unfoldable wing for a outward extension from the airborne body which will hardly exert any influence over the payload proportions of the airborne body.

For a wing possessing a rear spar, having the one end segment thereof pivotably connected with the second end segment of the nose spar which is remote from the bearing axis for the nose spar, and with a wing covering which in the extended condition covers the nose spar up to the rear spar, it has been found to be advantageous when the base spar has its second end segment, which is remote from the bearing axis for the nose spar, pivotably connected with the second end segment of the rear spar, and wherein the rear spar possesses two spar elements which are hingedly connected with each other. The second end segment of the rear spar is consequently not arranged to be slidable along the base bar in order to form a linkage triangle which is variable in its surface, but the second end segments of the base spar and of the rear spar are articulatedly connected to each other. Through this articulated connection, in comparison with a slidably movable arrangement of these two spar end segments, there is obtained a reduction in the friction which is encountered between these end segments such that with regard to effecting the unfolding; in essence, the outward extension of the wings, a motive device with a comparatively smaller energy accumulator will be adequate to be able to extend the wings from the airborne body and to unfold them. The result thereof, the capacity in the payload for the airborne body can be still further improved.

The first end segment of the base spa and the first end segment of the nose spar for a wing of the hereinabove last-described type; in effect, a wing which possesses a nose spar, a rear spar, a base or root spar, and a wing covering which extends over these spars, are preferably equipped with engaging elements which, up to the reaching of the final outwardly extended angular position for the nose spar, are in an operative connection with each other for the extension of the nose spar; whereby in the final extended position of the nose spar, the two spar elements of the rear spar form a stiff or rigid element, and the operative connection between the nose spar and the base spar is terminated. In order to stiffen the two spar elements of the rear spar in the final outwardly extended angular position between the nose spar and the base spar, or in essence, the airborne body, a stop may be arranged on respectively each of the two spar elements. In the same manner, the articulated or hinged connection between the two spar elements can be provided with a spring element which assists in forming the stiffening effect. In the position, in which the two spar elements of the rear spar form a stiff element, the two spar elements are preferably oriented in alignment with each other.

It has been ascertained as being especially advantageous in a last-described construction for the wing when the base spar, for the tensioning or tightening of the wing covering, is displaceable by means of the energy accumulator from the position which terminates the operative connection between the nose spar and the base spar, into a final or end position which is more remote from the bearing axis for the nose spar. As a result thereof, it is possible in a simple manner to tension the wing covering which is provided intermediate the nose spar and the rear spar, so as to thereby realize a still further improved stabilizing behavior for the airborne body which is equipped with wings of that type.

Another construction for the wing with at least one additional lamella or metal sheet element which extends in parallel with the nose spar in every angular position, whereby the sheet metal element or each sheet metal elements is pivotable movable about an associated bearing axis which is directed in parallel with the support axis for the nose spar is extendable simultaneously with the nose spar into a final position in which the nose spar and the at least one sheet metal element form the unfolded wing, and is distinguished in that the bearing axis for the at least one sheet metal element is arranged on the base spar, which is linearly displaceable by means of the energy storage between a basic or initial retracted position, a second position which there is formed the operative connection between the base spar and the nose spar, and into a final position in which the nose spar and the at least one sheet metal element assume their extended final angular position with regard to the airborne body whereby, for the stabilizing of the wing in the extended final position, there is pivotably supported an elongated stabilizing element at the second end segment of the nose spar which is remote from the bearing axis, and which stabilizing element, at the second end segment of the sheet metal element or of each sheet element which is remotely located from the associated bearing axis for the applicable sheet metal element, extends through between stop elements which are constructed on the associated sheet metal element. With such a wing, the wing surface is not determinated by the wing covering which is stretched or extended between the nose spar and the rear spar of the wing, but rather through the nose spar and the lamella or sheet metal element which is always at least approximately oriented in parallel with regard to the nose spar. Also, with respect to such an unfoldable wing which is extendable from the airborne body and which possesses at least one lamella or sheet metal element, because of the linearly displaceable base spar there is obtained a space-saving or compact drive or motive arrangement for the extendable wing. The extending sequence for the wing commences hereby only first in the second position thereof which produces the operative connection between the base spar and the nose spar, whereby the distance of the movement between the basic position of the base spar and this second position for the base spar is relatively small and can lie within the magnitude of a few millimeters. Due to this relatively small distance between the basic position and the second position for the base spar, upon an activation of the energy element of the drive or motive device for the base spar, there is obtained a quasi-impact or suddenlike start in the commencement of the extending procedure for the wing. The distance in the movement of the base spar between its second position and its final position is larger than the path of movement between the basic position and the second position for the base spar, whereby the distance between the second position and the final position of the base spar in particular, is dependent upon the final angular position between the nose spar and the at least one sheet metal element, and the base spar, or respectively, the longitudinal axis of the airborne body. For such a wing, which possesses at least one lamella or sheet metal element, the base spar remains in an operative connection with the nose spar in the final angular position. As a consequence thereof, there is obtained a precisely determined angular positioning for the outwardly extended wing. The stability of the extended wing, or respectively, its wing profile, is afforded in a simple manner by means of the elongated stabilizing element.

The base spar of a wing of the last-mentioned type can be provided with an engaging element on its first end segment proximate the bearing axis of the nose spar, and the nose spar can be equipped with a second engaging element on its first end segment, wherein the engaging elements come into operative engagement with each other in the second position of the base spar. As has been already mentioned, the engaging elements remain in an operative engagement with each other beginning from the second position of the base spar until its final position. With respect to these engaging elements, this can relate to an attachment or lug which is located on the base spar and to a cutout which is formed in the nose spar, and into which there engages the attachment or lug while projecting from the base spar so as to provide the operative interengagement between the base spar and the nose spar.

It has been ascertained as being expedient when there is provided a latching arrangement intermediate the airborne body and the base spar which is operative in the initial or, in essence, the stored or retracted position as well as in the final position of the base spar in which the wing is extended. The latching arrangement can be prestressed through the intermediary of a spring element and equipped with a shear pin which is engaged in a cutout provided in the base spar, when the elements of the extendable wing; in effect, when the base spar, the nose spar and the at least one sheet metal element, are arranged in their retracted initial o basic position. Upon initiating the extending movement for the wing, which is effectuated through intermediary the energy element of the drive or motive arrangement, the shear pin which is located on the latching device is sheared through, whereas the base spar will then freely move from its initial position into the second position in which there is assumed the operative connection between the base spar and the nose spar. Inasmuch as the base spar can thereby carry out a uniformly free movement up to reaching the second position, which is not influenced by the unfolding of the wing, it is possible to achieve a shearing through of the shear pin with a relatively low exertion of force without encountering any problems.

The lamella or sheet metal member, or each sheet metal member, preferably possesses two mutually spaced stop elements on the rear side thereof facing away from the nose spar, between which there extends through the elongated stabilizing element. In this manner, there is obtained a comparatively simple construction for the lamella or sheet metal elements and a simple arrangement of the elongated stabilizing element for the secure stabilizing of the entire wing in its extended final angular position.

During the unfolding procedure of the wing, in accordance therewith, there is effectuated the taking along of the lamella or sheet metal elements by means of the elongated stabilizing element which passes through between the stop elements on the sheet metal elements. The two most important components of a wing constructed pursuant to the last-mentioned type; in essence, consist of the linearly movable base spar and the elongated stabilizing element which, in the unfolded condition of the wing, forms a stiff rear edge for the wing.

BRIEF DESCRIPTION OF THE DRAWINGS

Further details, features and advantages of the invention can now be more readily ascertained from the following description of exemplary embodiments of the inventive wing, taken in conjunction with the accompanying drawings; in which.

DETAILED DESCRIPTION

Figures 1, 2, 3:
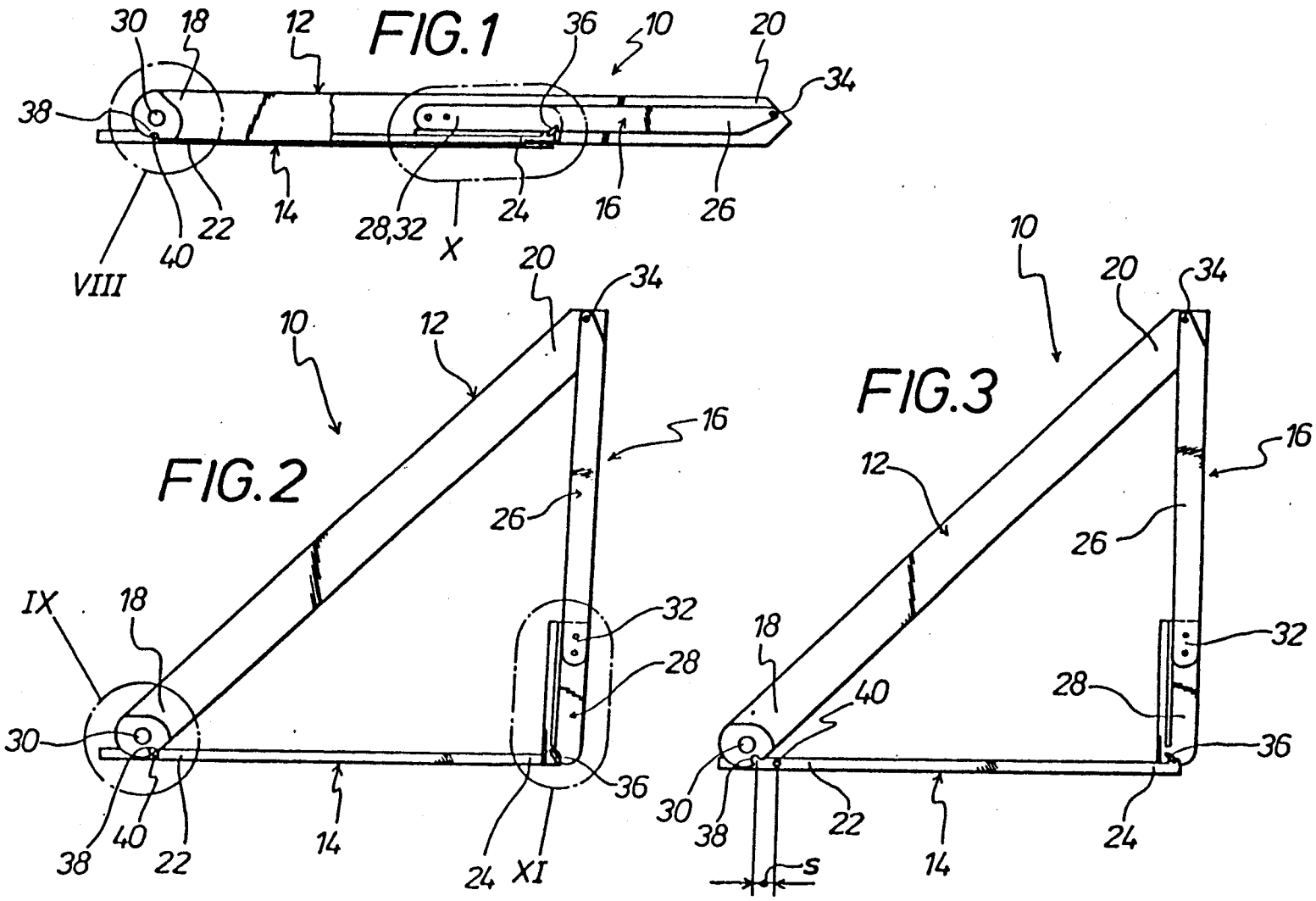
FIG. 1 illustrates a first embodiment of the extendable wing shown in the retracted basic or initial position thereof.
FIG. 2 illustrates a wing pursuant to FIG. 1 shown in the extended position, in which the nose spar assumes its final angular position relative to the base spar, and the rear spar which possesses two spar elements forms a stiff or rigid element.
FIG. 3 illustrates the wing pursuant to FIGS. and 2 in the tensioned position of the base spar and the rear spar, in which a covering (not shown) which extends over the nose spar and the rear spar is tensioned.
Figures 4, 5, 6, 7, 7A:
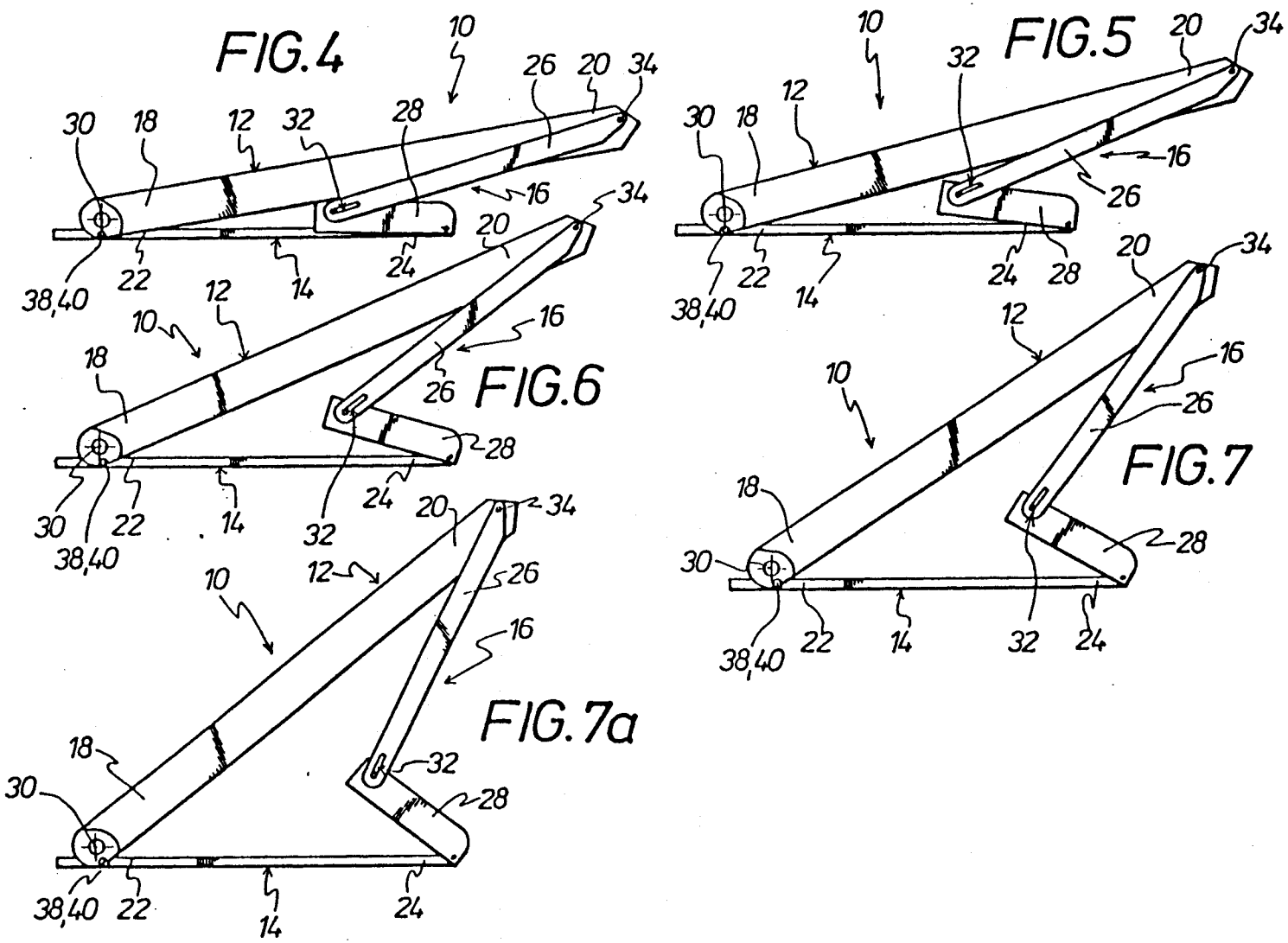
FIGS. 4 through 7 and 7*a* illustrate different angular positions of the nose spar and of the two spar elements of the rear spar relative to the linearly moving base spar during the extension of the wing from the basic position illustrated in FIG. 2 into the final angular position of the nose spar as shown in FIG. 2.

FIGS. 1 through 11 of the drawings illustrate a first embodiment of an unfoldable wing 10 which is extendable from an airborne body (not shown), and which possesses a nose spar 12, a base spar 14 and a rear spar 16. The nose spar 12 possesses a first end segment 18 and a second end segment 20; the base spar 14 possesses a first end segment 22 and a second end segment 24; and the rear spar 16 possesses a first spar element 26 and a second spar element 28. A bearing axis 30 extends through the first end segment 18 of the nose spar 12, and about which the nose spar 12 is pivotable from the initial basic position illustrated in FIG. 1 into the final angular position shown in FIG. 2. In the final angular position of the nose spar 12, the two spar elements 26 and 28, which are articulated or hingedly interconnected through a hinge 32, are directed in alignment with each other and form a stiff or rigid element for stabilizing the rear edge of the wing. The first spar element 26 of the rear spar 16 is hingedly interconnected with the second end segment 20 of the nose spar 10, whereby a hinge axis 34 is provided between these individual components. The second spar element 28 is hingedly connected with the second end segment 24 of the base spar 14, whereby a hinge connection 36 is provided between the last-mentioned components.

Figure 9:
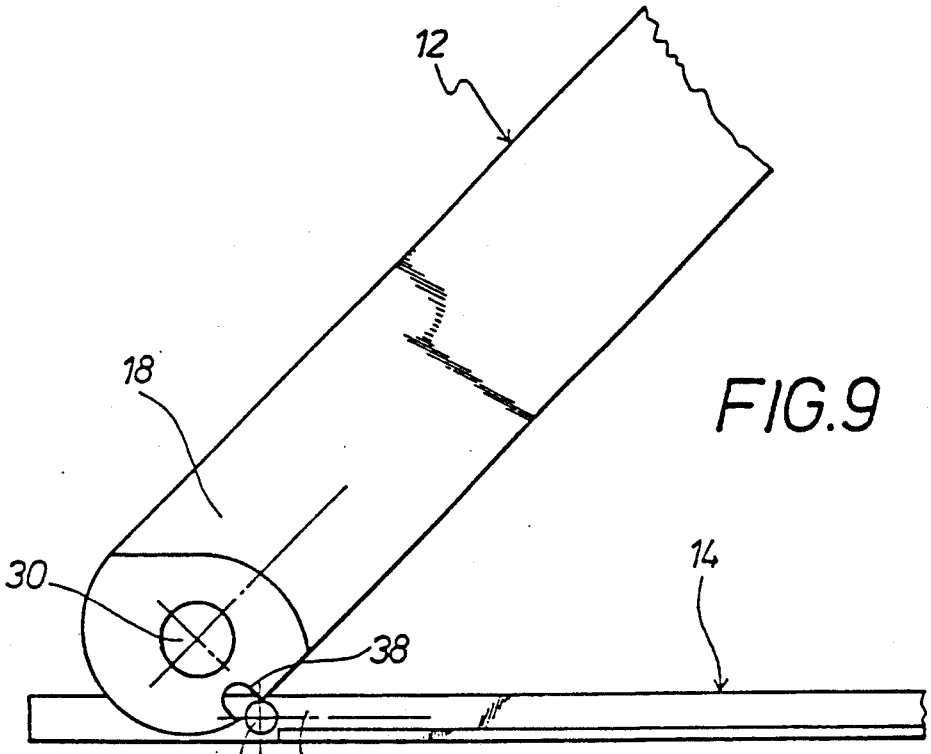
FIG. 9 illustrates, on an enlarged scale, the encircled detail IX shown in FIG. 2.

The first end segment 18 of the nose spar 18 and the first end section 22 of the base spar 14 are respectively equipped with engaging elements 38, 40, whereby the engaging element 38, as can be clearly ascertained from FIG. 9, is a cutout which is formed in the first end segment 18 of the nose spar 12, whereas the second engaging element 40 is an attachment or lug which projects from the base spar 14.

Figure 8:
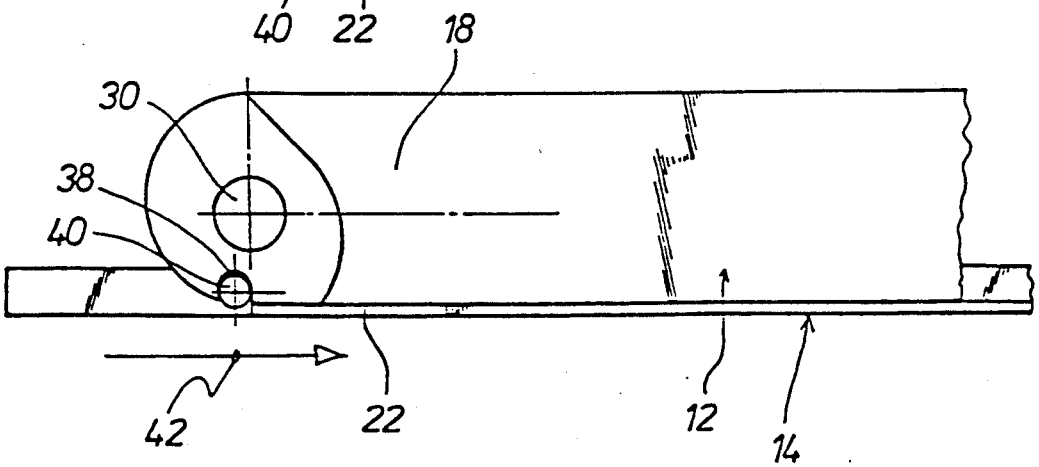
FIG. 8 illustrates, on an enlarged scale, the encircled detail VIII in FIG. 1.

The two engaging elements 38 and 40 are in operative engagement commencing from the basic or initially retracted position of the wing 10, as illustrated in FIG. 1, up to the final angular position of the nose spar 12 as shown in FIG. 2 whereby, in this final angular position of the nose spar 12, the two spar elements 26 and 28 of the rear spar 16 produce a stiff or rigid element constituting the rear edge of the wing. The unfolding of the nose spar or, respectively the wing 10, is effected through a linear movement of the base spar 14 from the basic position thereof as illustrated in FIG. 8 along the direction of the arrow which is illustrated in FIG. 8 and identified by reference numeral 42 up to the second position for the base spar 14 which is illustrated in FIG. 9. In this second position of the base spar 14 the operative engagement between the two engaging elements 38 and 40 is terminated, as can be clearly ascertained from FIG. 9, so that in conjunction with the second position of the base spar 14 it is possible to move the base spar linearly further by a small distance s, as is illustrated in FIG. 3, from the engaging element 38 in the direction of arrow 42 (as shown in FIG. 8) away from the bearing axis 30 into a final position or shown in FIG. 3, in which the rear spar 16 which forms a rigid element carries out a small pivoting movement about the hinge axis 34 in the opposite clockwise direction, in which the wing covering (not shown) which is arranged between the nose spar and the rear spar 16 is tensioned.

Figure 11:
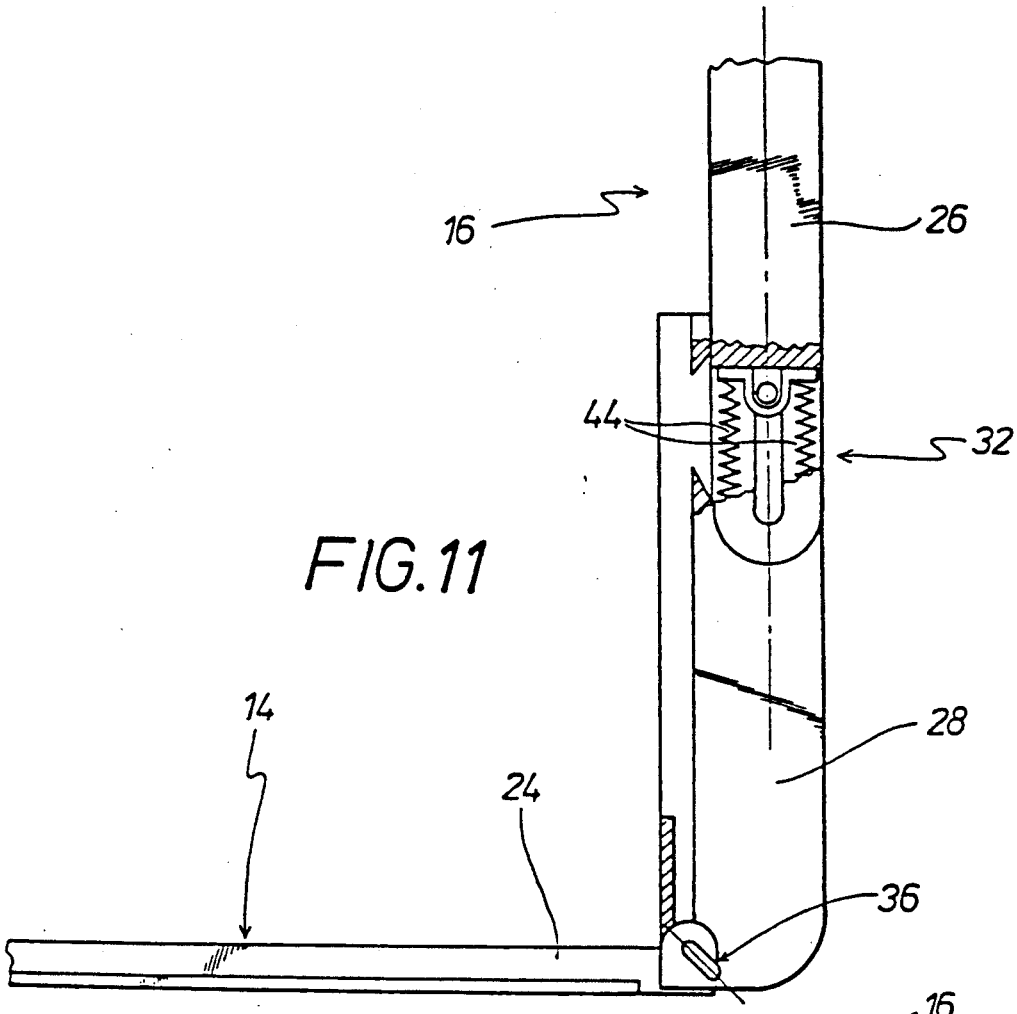
FIG. 11 illustrates, on an enlarged scale, the encircled detail XI shown in FIG. 2.
Figure 10:
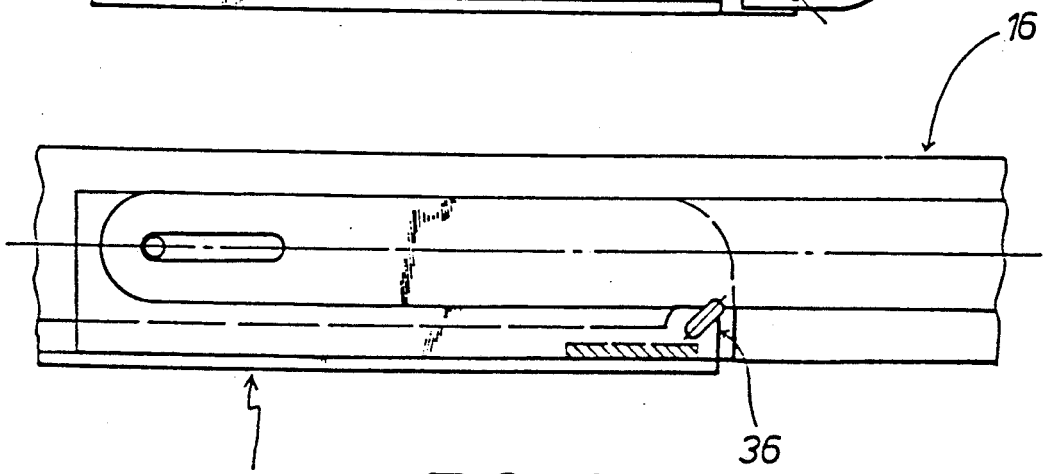
FIG. 10 illustrates, on an enlarged scale, the encircled detail X in FIG. 1.

FIG. 11 illustrates, in a partly sectional representation, a construction of the hinge or joint 32 between the first and second spar elements 26, 28, which is formed with the intermediary of a spring element 44. The spring element 44 is at all times mechanically prestressed; meaning, in the basic position illustrated in FIG. 1, as well as in the extended position shown in FIGS. 2 or 3. With respect to the spring element, this can pertain, for example, to a helical or coil compression spring.

In FIGS. 1 through 11 of the drawings, the same constructional details are always identified by the same reference numerals, so that it is unnecessary in connection with all individual figures to always refer in detail to all of these specific components.

Figures 12, 13:
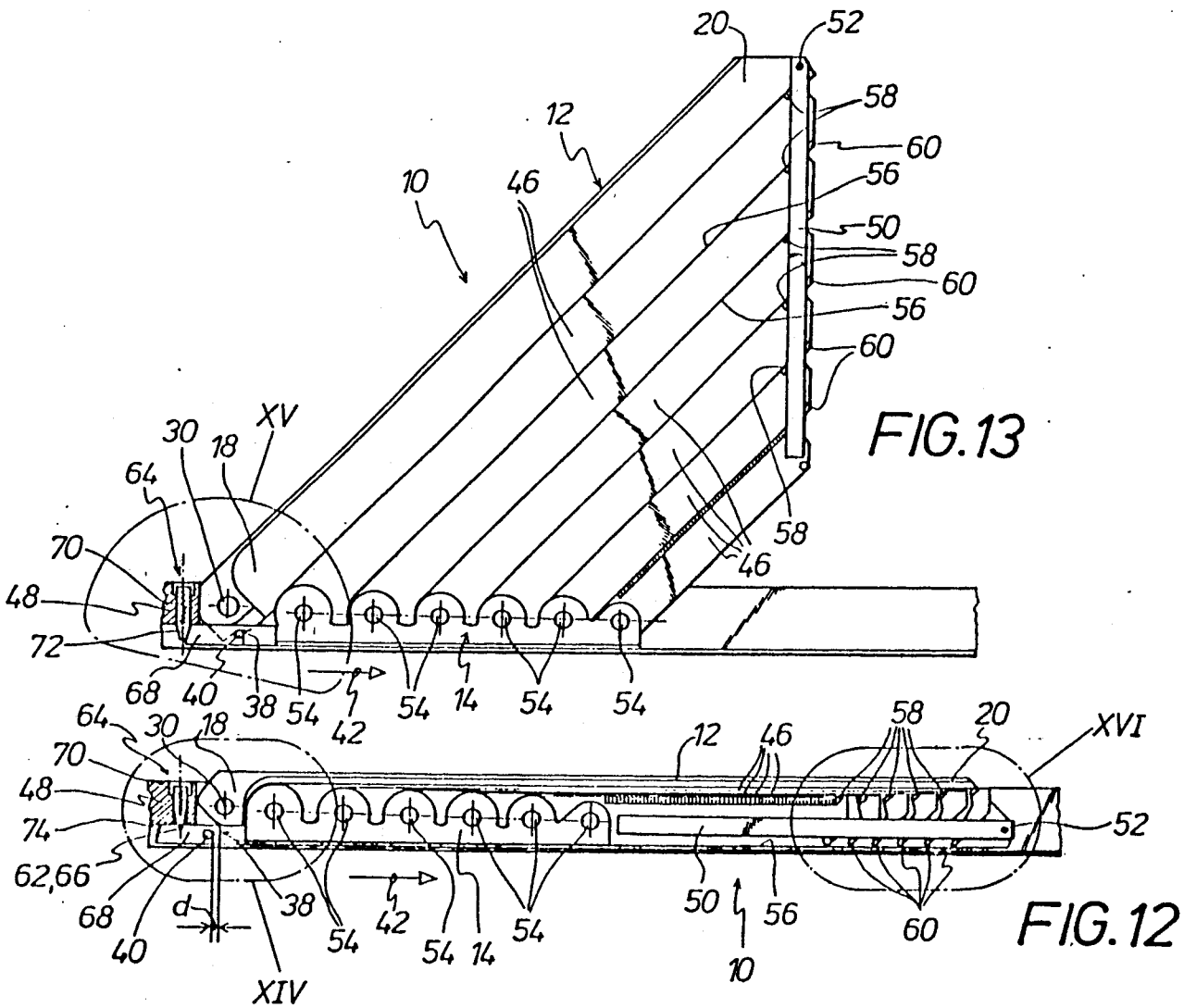
FIG. 12 illustrates a second embodiment of the wing shown in the retracted basic or initial position.
FIG. 13 illustrates the wing pursuant to FIG. 12 in the unfolded final extended angular position.

A second exemplary embodiment of the extendable wing is illustrated in FIGS. 12 and 13. This particular of the wing 10 possesses a nose spar 12, a base spar 14 and a plurality of lamella or sheet metal elements 46, in which the sheet metal elements 46 are oriented at least approximately in parallel with the nose spar 12 in every angular position; in essence, in the unfolded position of the wing 10 relative to the nose spar 12. The nose spar 12 is pivotable about a bearing axis 30 which is located on the partly sectionally shown airborne body 48. The bearing axis 30 extends through the first end segment 18 of the nose spar 12. Hingedly mounted on the second end segment 20 of the nose spar 12 is an elongated stabilizing element 50, for which purpose there is provided a bearing axis 52. Each lamella or sheet metal element 46 is pivotably supported on the base spar 14 by means of an associated bearing axis 54. The sheet metal elements 46 are each provided with two stop elements 58 and 60 on their rear sides 56 facing away from the nose spar 12, between which stop elements there passes through the elongated stabilizing element 50.

Also in this construction of the extendable wing 10 is the nose spar 12 equipped with an engaging element 38 and the base spar 14 with an engaging element 40, which are operatively interengageable.

In FIG. 12 of the drawing, the wing is illustrated in its retracted initial or basic position, in which the engaging elements 38 and 40 are set a short distance d from each other. Within this spacing d, the base spar 14 can move quasi-freely along the direction of the arrow 42, without this leading to an unfolding movement of the nose spar 12 and concurrently that of the sheet metal elements 46. During the movement along the short distance d, there is caused the shearing through of a shear pin 62 (as particularly shown in FIG. 12) which is arranged on a latching device 64 and which pin, in the basic position of the wing 10 illustrated in FIG. 12, engages into a latching cutout 66 provided for this purpose in an extension 68 of the base bar 14. The latching device 64 is mechanically prestressed through the action of a spring element 70, so that the latching device 64 has a conical contact portion 72 contacting against a tapered end surface 74 on the extension 68 of the base spar 14 when, with the aid of the base spar 14; in essence, the engaging elements 38 and 40, the nose spar 12 and thereby simultaneously the scent metal elements 46 are extended from the airborne body 48 into their final angular position, as is especially clearly ascertainable from FIG. 13. With the aid of the latching device 64, there is thus obtained a secure maintenance of the wing 10 in the extended position. For this purpose, the first end segment 18 of the nose spar 12 is equipped with a contact portion which closely contacts against a complimentary contact on the airborne body 48 in the final angular position.

What is claimed is:

1. An unfoldable wing which is extendable from an airborne body, said wing comprising a nose spar having a first end segment pivotably connected to said airborne body at a bearing axis for outward extension of said wing from a retracted position which is generally parallel with the longitudinal axis of said airborne body in response to an application of a turning moment to said wing, said wing including a base spar which is axially displaceable in parallel with the longitudinal axis of said airborne body, said base spar having a first end segment proximate said bearing axis and being at least temporarily arranged in an operative connection with said nose spar at a point which is offset from said bearing axis for creating the turning moment for during the extension of said wing.

2. A wing as claimed in claim 1, comprising a rear spar having a first end segment hingedly connected with a second end segment of said nose spar which is remote from the bearing axis for said nose spar; and a wing covering which in the extended condition of the wing covers said nose spar up to the rear spar, said base spar having a second end segment remote from the bearing axis for the nose spar and which is hingedly connected a second end segment of the rear spar, said read spar including two spar elements which are hingedly interconnected.

3. A wing as claimed in claim 2, wherein said first end segment of the base spar and said first end segment of the nose spar including engaging means in operative engagement for effectuating the extension of said nose spar until reaching the extended final angular position of the nose spar, said two spar elements of the rear spar in the final extended end position of said nose spar forming a rigid element and terminating the operative connection between the nose spar and the base spar.

4. A wing as claimed in claim 3, wherein the base spar, for effectuating a tensioning of the wing covering, is displaceable by the energy accumulator from the position termination the operative connection into an end position which is more remote from the bearing axis for the nose spar.

5. A wing as claimed in claim 1, wherein at least one sheet metal element is extendable approximately in parallel with said nose spar in every angular position, said at least sheet metal element being pivotable simultaneously with said nose spar about bearing axis which is oriented in parallel with the bearing axis for the nose spar into a final angular position in which said nose spar and said at least one sheet metal element form the extended wing, said bearing axis of said at least one sheet metal element being located on the base spar which is linearly displaceable by the energy accumulator between a retracted basic position, a second position which forms the operative connection between the base spar and the nose spar and a final position in which the nose spar and said at least one sheet metal element assume the extended final angular position relative to the airborne body; an elongated stabilizing element for the stabilization of the wing in the extended final position being pivotably supported on the second end segment of the nose spar which is remote from the bearing axis for the nose spar, and at the second end segment of said at least sheet metal element which is remote from the bearing axis for said sheet metal element passing through intermediate stop elements which are formed on said at least one sheet metal element.

6. A wing as claimed in claim 5, wherein engaging means are provided on said base spar at the first end segment thereof proximate the bearing axis for the nose spar and on the first end segment of said nose spar towards the bearing axis, which means are in operative engagement in the second position of the base spar.

7. A wing as claimed in claim 6, wherein said engaging means remain in an operative engagement upon movement from the second position of the base spar into the final end position thereof.

8. A wing as claimed in claim 5, wherein latching means are operative intermediate said airborne body and said base spar in the basic retracted position and in the final position of the base spar.

9. A wing as claimed in claim 8, wherein the latching means is prestressed by a spring element.

10. A wing as claimed in claim 5, wherein said at least one sheet metal member includes two spaced stop elements on the rear side facing away from the nose spar between which there passes through the elongated stabilizing element.

* * * * *